United States Patent [19]

Adair

[11] 4,148,508

[45] Apr. 10, 1979

[54] LOCKING DEVICE FOR SLIDING WINDOWS AND THE LIKE

[76] Inventor: Ronald B. Adair, 20801 Hunter La., Huntington Beach, Calif. 92646

[21] Appl. No.: 924,292

[22] Filed: Jul. 13, 1978

[51] Int. Cl.[2] ..... E05C 19/18

[52] U.S. Cl. ..... 292/258; 292/291; 292/DIG. 46

[58] Field of Search ..... 292/258, 288, 291, 294, 292/DIG. 20, DIG. 46, DIG. 47

[56] References Cited

U.S. PATENT DOCUMENTS

| | | | |
|---|---|---|---|
| 3,085,300 | 4/1963 | Carlston | 292/DIG. 46 |
| 3,347,585 | 10/1967 | Chmura | 292/288 X |
| 3,490,802 | 1/1970 | Zeit | 292/288 X |
| 3,640,559 | 2/1972 | Royer | 292/288 |
| 3,756,641 | 9/1973 | Dugan | 292/258 |
| 3,807,779 | 4/1974 | Enders | 292/DIG. 46 X |
| 3,929,362 | 12/1975 | Petroff | 292/291 |
| 3,938,839 | 2/1976 | Collier | 292/DIG. 46 X |
| 3,975,041 | 8/1976 | Edison | 292/258 |
| 3,984,135 | 10/1976 | Dathe | 292/DIG. 20 X |

*Primary Examiner*—J. Franklin Foss
*Attorney, Agent, or Firm*—Francis X. Lojacono

[57] ABSTRACT

A locking device for sliding windows and doors, including a removal-preventing bar, wherein the window is freely slidable within a track formed in the lower frame portion of a window casement, the locking device comprising a main body having a lower groove to receive a flanged wall of the track, and the body being secured thereto by an adjustable screw, the body further including a lateral-extending boss member for direct engagement with the sliding window to limit lateral movement thereof. The removal-preventing bar is secured in the main body and projects longitudinally therefrom adjacent the lower frame portion of the window and above the track of the casement, thereby preventing the window from being removed from the casement frame structure.

7 Claims, 5 Drawing Figures

LOCKING DEVICE FOR SLIDING WINDOWS AND THE LIKE

BACKGROUND OF THE INVENTION

1. Field of the Invention

This invention relates generally to lock devices, and is more particularly directed to a removable lock and stop mechanism for preventing both the sliding movement and the removal by lifting-out sliding panels or closures such as found in slidable windows, doors and the like.

2. Description of the Prior Art

As is well known in the art, various problems and difficulties are encountered in providing suitable means for limiting the sliding movement of panels and closures, more particularly sliding windows which are mounted in casements having a channel-like frame structure, the lower member being formed as a track to receive the window. A further difficulty involves the preventing of unwanted removal of the window or like panel from its associated frame structure.

That is, it is well known that sliding windows and doors are positioned within a casement frame structure, wherein the upper channel guide of the casement freely receives the upper edge of the window frame—thus allowing the window to be lifted upwardly, thereby freeing the lower edge of the window from the lower channel track of the casement frame for removal of the window or like panel.

As examples of the art, one can refer to the sliding panel lock as disclosed in U.S. Pat. No. 3,975,041 which provides a clamping-wedge member for wedging against the corner of the sliding panel.

U.S. Pat. No. 3,415,560 is a lock for sliding windows wherein this device employs a ball and a spring structure to prevent movement of the window.

A locking mechanism for sliding doors is disclosed in U.S. Pat. No. 3,427,059; and U.S. Pat. No. 3,428,349 discloses a stop for limiting the opening movement of closures, such as slidable windows and doors. This device does not prevent the removal of the slidable closure from its casement frame structure, and only regulates the sliding movement therein.

Another type of lock for sliding doors is disclosed in U.S. Pat. No. 3,490,802 which provides a stop block having a lock pin extending from the block to engagement with one of the doors.

SUMMARY OF THE INVENTION

The invention herein disclosed provides a device to prevent or limit the sliding movement of a closure or panel, such as a sliding casement window or door.

In addition, this device also includes a means by which the panel or window is prevented from being removed from the casement frame structure. That is, the device comprises a main body adapted to be removably secured to the channel track of the casement framework, wherein the body is provided with an elongated bar member which is affixed to the main body so as to extend longitudinally along the upper edge of the track and adjacent the lower frame member of the slidable window. Thus, the window is free to be raised out of the track, but can not pass over the bar member when the window is in a closed mode.

OBJECTS AND ADVANTAGES OF THE INVENTION

The present invention has for an object to provide a new and improved lock device for preventing or limiting the movement of closures or sliding panels.

Another object of the invention is to provide a locking device for slidable windows and doors which is not readily detachable from the outside of a building and which is substantially burglar-resistant.

A further object of the present invention is to provide a lock device of this character wherein it embodies the dual function of preventing the sliding action of a slidable panel or closure, and the removal or lifting-out of the closure or slidable panel from within the confines of its structural or containing framework.

A still further object of the invention is to provide a lock device of this character that can be easily secured or removed manually, without the aid of special tools, and which will perform its function without modification to the structure of the closure or sliding panel, or its structural framework, and is easily installed by persons having little mechanical skill.

It is another object of the invention to provide a device of this characture with potentially universal application.

It is still another object of the invention to provide a lock device of this type that is simple in construction and low-cost in manufacturing.

It is a further object of the present invention to provide a lock device of this character that is strong and durable in construction, and efficient in function, yet providing ease of application and reliability in use.

It is still a further object of the invention to provide a device of this character that is convertible for use on both right-hand and left-hand opening closures and slidable panels.

A still further object is to provide a lock device of the character described that is capable of securing a slidable panel or closure in any open position selected.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
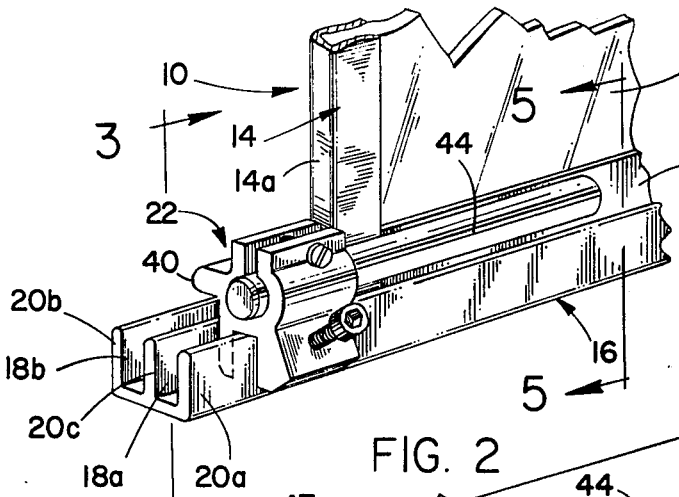
FIG. 1 is a pictorial view of the present invention mounted on a portion of a frame structure positioned adjacent a slidable window.
Figure 2:
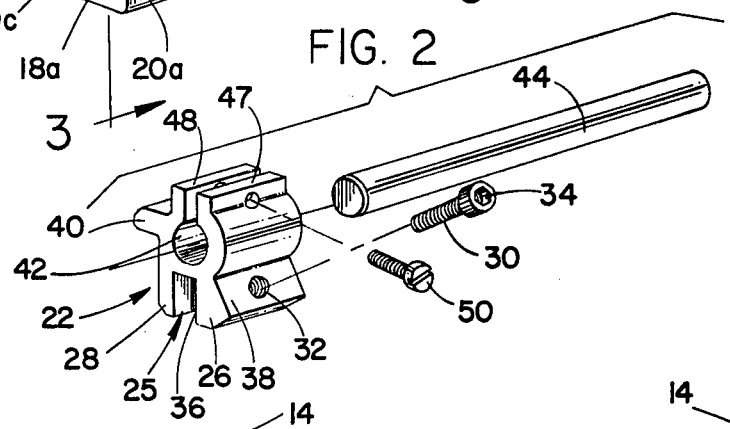
FIG. 2 is an exploded perspective view of the lock device.

Referring more particularly to FIG. 1, there is shown a closure or panel defined by a slidable window, generally indicated at 10. It should be understood that the present invention may be used with various types of slidable closures or panels, but it is herein shown and described associated with a slidable window 10 of conventional structure, such as window panel 12 having a window frame structure 14, wherein the leading vertical frame member 14*a*, and the lower longitudinal frame member 14*b* are parts thereof.

As is generally found in the art, window 10 is slidably mounted within a casement structure having four structural frame members, wherein the lower member indicated at 16 is shown thereof.

Each casement frame member comprises at least two parallel contiguous channels 18*a* and 18*b* formed by oppositely disposed flange walls 20*a* and 20*b*, and a central intermediate wall 20*c*. It will be noted that window 10 is slidably disposed in channel 18*a* which will also be defined as a track for window 10 to slide therein.

The present invention comprises a locking device, indicated generally at 22, which is adjustably mounted along flange wall 20*a* of frame 16. Locking device 22 provides a means to locate the window 10 at a selective position along track 18*a*, wherein window 10 can be locked anywhere between a fully closed or a fully opened position. However, the present invention also provides a means for preventing the window from being removed from the casement frame structure, which will hereafter be described.

Figure 3:
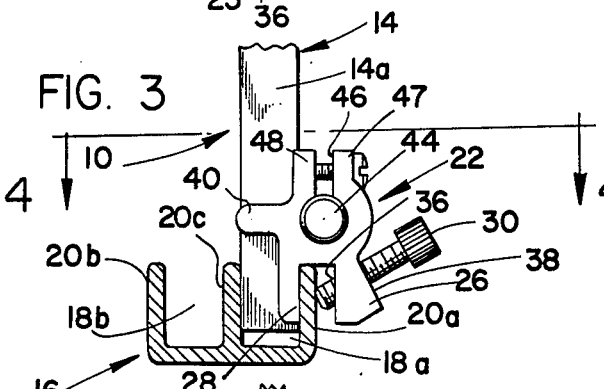
FIG. 3 is an enlarged end view taken substantially along line 3—3 of FIG. 1.
Figure 5:
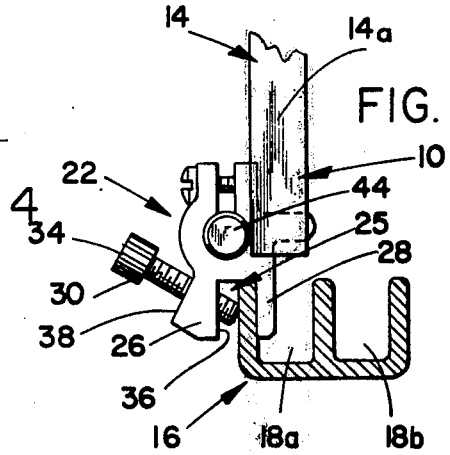
FIG. 5 is a view taken substantially in the direction of line 5—5 of FIG. 1, wherein the window is lifted from the channel track and abuts the bar member.

Locking device 22 comprises a main body member 24 wherein the lower section thereof includes an enlarged slot 25 disposed longitudinally therein, wherein a pair of oppositely positioned depending leg members 26 and 28 are defined thereby, slot 25 being wide enough to receive one of said flanges 20*a* and 20*b*, as illustrated in FIGS. 1, 3 and 5.

A securing means is also provided which comprises a screw 30 being threadably received in threaded bore 32 centrally located in leg member 26. Screw 30 may be of any suitable type. That is, screw 30 is shown having an allen-head arrangement 34, but may be a conventional thumb screw as well, so as to obviate the need for tools to tighten same.

Leg member 26 is formed having an inner perpendicular wall 36 and an outer inclined wall 38 to provide a sufficiently thick wall, so as to readily allow screw 30 to be tightened against wall 20*a* with sufficient strength to hold body 22 in place.

Figure 4:
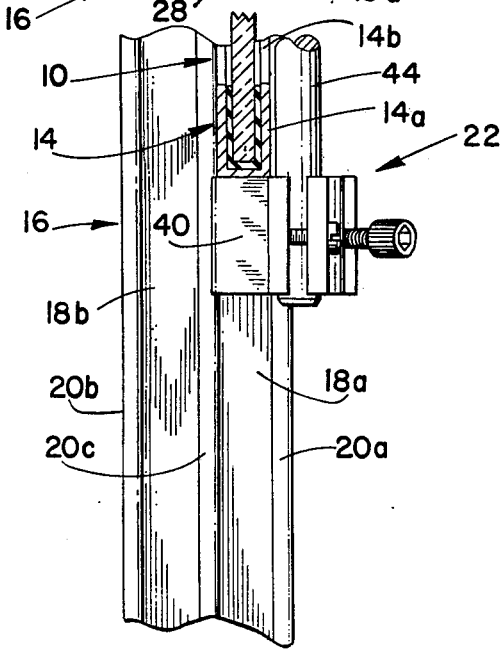
FIG. 4 is a view taken substantially along line 4—4 of FIG. 3, wherein the lock is seen as a top view with the elongated bar positioned adjacent the window.

Integrally formed as part of body 22 is a laterally projecting boss 40, said boss being disposed along the inner side of body 22 as seen in FIG. 4, whereby it extends across channel 18*a*. Thus, boss 40 establishes a positive stop means for window 10 to control the lateral positioning of said window in channel track 18*a*.

Accordingly, to prevent window 10 from being removed by someone from the outside location of the window—that is the side defined by flange wall 20*b*—body 22 is further provided with a longitudinal bore 42, wherein an elongated bar member 44 is adjustably positioned therein. A means for clamping bar 44 is provided in body 22, wherein the upper portion of said body is formed having a slit 46 to allow bore 42 to readily receive bar 44. Slit 46 defines a jaw formed between ribs 47 and 48, rib 48 being threaded to receive screw 50. When bar 44 is positioned in bore 42 screw 50 is tightened, thereby clamping bar 44 therein.

When window 10 is to be locked in a closed position, body 22 is secured in an abutting relationship against window frame member 14*a*, thus preventing window 10 from being slidable to an open position. At the same-time, bar 44 is also positioned adjacent to and along the lower frame member 14*b* of window 10, as seen in FIGS. 1 and 4.

However, in FIG. 5, window 10 is shown removed frame channel track 18*a*. At this time, the upper portion of window 10 is still confined within the upper channel of casement 16 (not shown); and the lower portion thereof—that is frame member 14*b*—is caught behind bar 44, thus preventing the removal of window frame 10 from its associated casement frame structure. Boss 40 also positioned above channel 18*a* at a height to prevent window 10 from being raised thereover.

The invention and its attendant advantages will be understood from the foregoing description, and it will be apparent that various changes may be made in the form, construction and arrangement of the parts of the invention without departing from the spirit and scope thereof, or sacrificing its material advantages, the arrangement hereinbefore described being merely by way of example; and I do not wish to be restricted to the specific form shown or uses mentioned, except as defined in the accompanying claims.

Wherein I claim:

1. A means for limiting the sliding movement and preventing the removal of a sliding panel of the type associated with a channelled casement frame structure, the lower portion of said panel being slidably received in the lower channel track of said casement, wherein said means comprises:

a main body member having oppositely disposed depending leg members;

a longitudinal slot defined between said leg members and adapted to be secured to said channel track;

means for selectively securing said main body to said channel track;

a laterally projecting boss member longitudinally formed along said body member positioned for abutting engagement with said sliding panel;

a longitudinally disposed bore formed in said body; and an elongated bar member mounted to said body member and extending longitudinally outward from one side thereof, wherein the bar is positioned over part of said channel track and adjacent the lower edge of said sliding panel to prevent removal of said panel from said channel track thereof.

2. A means as recited in claim 1, wherein said main body includes means for adjustably clamping said bar longitudinally within said main body,

3. A means as recited in claim 2, wherein said securing means comprises a first screw member threadably received in one of said leg members whereby a flange wall of said channel track is secured between said other depending leg member and said screw.

4. A means as recited in claim 3, wherein said clamping means comprises a slit formed in the upper portion of said body member defining a jaw formed by a pair of rib members and a second screw disposed in said rib members to tighten said rib members together, thereby clamping said bar in said bore.

5. A means as recited in claim 4, wherein one of said depending leg members includes an inner perpendicular wall and an outer inclined wall to provide a sufficient thickness thereof to receive said first screw member therein.

6. A means as recited in claim 5, wherein said panel is a sliding window having the window frame structure adapted to be slidably received in said casement frame structure.

7. A means as recited in claim 5, wherein said panel is a sliding door having a door frame structure adapted to be slidably received in said casement frame structure.

* * * * *